United States Patent [19]

Boehmig

[11] Patent Number: 4,679,374

[45] Date of Patent: Jul. 14, 1987

[54] BUILDING CONSTRUCTION METHOD

[76] Inventor: Robert Boehmig, 850 Glenairy Dr., NE., Atlanta, Ga. 30328

[21] Appl. No.: 677,345

[22] Filed: Dec. 3, 1984

[51] Int. Cl.[4] ..... E04G 21/14

[52] U.S. Cl. ..... 52/745; 52/741

[58] Field of Search ..... 52/745, 741

[56] References Cited

U.S. PATENT DOCUMENTS

| | | | |
|---|---|---|---|
| 2,871,544 | 2/1959 | Youtz | 52/745 |
| 2,964,143 | 12/1960 | Fayeton | 52/745 |
| 2,995,799 | 8/1961 | Youtz | 52/745 |
| 3,053,015 | 9/1962 | Graham | 52/745 |
| 3,179,374 | 4/1965 | Walli | 52/745 |
| 3,435,583 | 4/1969 | Ben-Aziz | 52/745 |
| 3,490,191 | 1/1970 | Ekblom | 52/745 |
| 3,722,169 | 3/1973 | Boehmig | 52/745 |
| 3,748,805 | 7/1973 | Boros | 52/745 |
| 3,828,512 | 8/1974 | Johnson | 52/745 |
| 3,918,222 | 11/1975 | Bahramian | 52/745 |

FOREIGN PATENT DOCUMENTS

| | | | |
|---|---|---|---|
| 2028905 | 3/1980 | United Kingdom | 52/745 |

*Primary Examiner*—William F. Pate, III
*Assistant Examiner*—Michael Safavi
*Attorney, Agent, or Firm*—Banner, Birch, McKie & Beckett

[57] ABSTRACT

The method of constructing single story building structures involves installing upon a prepared ground surface an array of upstanding load-supporting columns in spaced parallel lines and transverse parallel rows to define bays between adjacent column lines and define a rectangular panel area between each group of four columns at the corners of each such area. Primary and secondary panels are assembled in the panel areas at a convenient working height near the ground surface with the primary panels to form the roof structure over alternate bays and the secondary panels to form the roof structure for the bays intermediate these alternate bays. Each primary panel includes beams of a length to extend between adjacent columns in a line of columns, the beams being located at each end of the primary panel, and spaced joists secured perpendicularly to these beams with joist bridging secured perpendicularly of such joists. Each secondary panel includes spaced parallel joists temporarily secured perpendicularly of the beams of the primary panels in adjacent alternate bays and joist bridging secured perpendicularly of the secondary panel joists. The endmost joists of each panel are spaced inwardly of the ends of the beams. Thereafter, the secondary panel joists are disconnected from the primary panel beams and selected panels moved into a storage position where predetermined panels overlie one another, thereby clearing a portion of the intermediate bays with this cleared portion then being available to accommodate lifting equipment which successively raises the individual panels for connection to the upper ends of the columns located at the four corners of each panel area. Gap sections are installed in the roof gaps overlying each row of columns to complete the building roofing. Essentially all electrical and mechanical facilities for the building can be installed on the panels while the panels are being assembled near the ground surface.

10 Claims, 6 Drawing Figures

BUILDING CONSTRUCTION METHOD

BACKGROUND OF THE INVENTION

1. Field of the Invention

This invention relates to a method of constructing single story building structures, particularly those utilizing lightweight steel, aluminum or wood members. The method invention is characterized by improvements in worker accessibility to the components being assembled and safety while achieving economy, efficiency and speed of construction in comparison with conventional construction procedures.

2. Description of the Prior Art

In the usual construction of single story lightweight steel buildings, it has become conventional to follow the procedure of grading the site to its approximate final elevation after which column footings of concrete are installed. Upright columns are then installed on these foundation footings, the column baseplate being anchored to the anchor bolts previously installed and projecting from these foundation footings.

Thereafter, beams are installed between the upper ends of the columns to be supported by the columns. Steel joists are placed on and welded to the beams with the usual joist spacing being in the order of five feet. Joist bridging is then installed at right angles to the joists to stabilize the entire assembly.

Finally, steel roof decking usually of formed sheet metal is placed transversely of the joists and welded to the joists. These roof deck sheets are usually 30 to 36 inches in width and formed to interlock so as to provide a continuous surface with each deck sheet being 20 feet, more or less, in length.

Single story buildings of the above described type are usually erected by installing, in order, columns, beams, joists and joist bridging. Under conventional construction procedures, each of these elements is individually lifted by crane and then secured in the place at the elevated level for the final roof structure of the building.

Generally, the roof deck sheets, in bundles, are then crane lifted to this elevated roof level and distributed out over the joists and thereafter welded to the joists to form the roof deck system. Insulation and roofing are then generally installed to complete this phase of the single story building structure.

A floor slab can be placed prior to or after erection of the above-mentioned structural frame. Then exterior walls and interior partitions are installed. Installation of electrical and mechanical facilities for the building follow to complete the building.

A drawback to the above-described prior art construction procedures for single story buildings is that a crane is required throughout the construction of the building and particularly its roof structure. This continous necessity for the presence of a lifting crane materially adds to the building cost.

Also the construction workers must carry out their work at the elevated height of the roof level in installing the beams, joists, joist bridging and roof decking. Aside from the hazards to these workers carrying out their duties at the elevated roof level, attempting to carry out these duties under marginal weather conditions can make working at these elevated heights unacceptably unsafe. Additionally, elevated platforms are needed for installing the electrical and mechanical facilities which are to be supported on or contained within the roof structure once it has been assembled at the top of the upstanding columns.

Attempts to overcome some of the above-mentioned disadvantages for the above-described conventional construction techniques for constructing a single story buildings have gone so far as to assemble a roof structure panel made up solely of joists and bridging at a location nearby the building site at ground level and thereafter raise this skeleton panel of joists and bridging for welding the ends of the joists to the beams which have already been secured between the upper ends of adjacent upstanding columns that are to support the roof structure. Still, this leaves a major portion of the construction work to be carried out at the elevated height of the roof level. All of the joists must be welded to the beams at the elevated roof level, the roof decking must be lifted, spread out and welded to the joists at the roof level and all of the electrical and mechanical facilities that are to be carried on or within the roof structure must be raised, installed and connected, also at the roof level height.

SUMMARY OF THE INVENTION

The improved characteristics for the present invention of worker accessibility and safety with economy, efficiency and speed over conventional construction procedures are realized by assembling the structural elements for the entire roof structure near ground level in the form of primary and secondary roof structure panels. Selective panels are then temporarily stored in overlying relation to each other to clear a portion of the ground surface surrounding the base of the upstanding columns. This cleared space is thus available to accommodate a lifting crane which is moved into place and utilized to lift the nearly completed roof system, one panel at a time, to the final elevated position where the beams of the primary panels are connected to the upper ends of the columns and the joists of the secondary panels are connected to the beams of the primary panels to form the building roof.

While still near the ground level, essentially all electrical and mechanical facilities needed for the building can be installed, thus eliminating the prior method of installing these items by workers carrying out their duties with a good degree of inefficiency while working from hazardous elevated platforms lifted to the roof level.

A further advantage of the present invention flows from the fact that, contrary to usual practice, the endmost roof joists on a panel are not located on the center line of the row of columns which are to support the panel. Instead these endmost roof joists are secured inwardly of the ends of the panel beams. This inward spacing of he endmost roof joists allows for the temporary storage of the secondary panels immediately beneath the primary panels adjacent ground level, thus enabling easy clearing of a portion of the ground level to accommodate the present of the lifting crane on this cleared surface. Also, positioning the endmost roof joists inwardly of the ends of the beams making up the panels permits the installation of windbracing trusses along the column center lines. These trusses along the column center lines can be proportioned to accommodate anticipated wind loadings only and are therefor designed independent of gravity loads.

It is thus a principal object of the instant invention to provide a building construction method for single story buildings of unlimited area utilizing light-weight construction materials whereby the construction can be carried out near ground level essentially in its entirety and then the roof structure lifted panel by panel to its final position at the intended elevated roof level.

A further important object of the invention is to provide a construction method wherein roof structure panels are assembled at ground level with selected panels then being temporarily stored in overlying relationship to each other to provide access aisles throughout the entire building area which can then accommodate lifting equipment to successively raise the panels to the upper ends of the load supporting columns where primary panel beams are connected to such columns and secondary panel joists are connected to the primary panel beams.

A further object of this invention in accordance with the above object is to enable the structural members for the roof structure panels to be assembled with light equipment, such as a forklift truck, this assembly being carried out near ground level at a convenient and safe location for workers to perform their tasks.

A further object of the invention is to provide a building construction method wherein final erection of building panels can be carried out by lifting equipment, such as a mobile crane, operating in an area immediately adjacent to the roof system panel that it is to lift to final position at the roof level.

An additional object of the invention is to provide for construction of a single story building wherein intended roof mounted equipment or machinery can be installed upon roof structure panels while assembly is being carried out near ground level and wherein electrical and mechanical facilities consisting of conduit, fixtures, piping and duct work can be installed and fitted near ground level to be later lifted with the roof structure panels to the final elevated roof level.

The above and other objects of the invention will become apparent upon consideration of the detailed description of preferred embodiments of the invention given in connection with the following described drawings which form a part of this detailed description.

DESCRIPTION OF THE PREFERRED EMBODIMENTS

Figure 1:
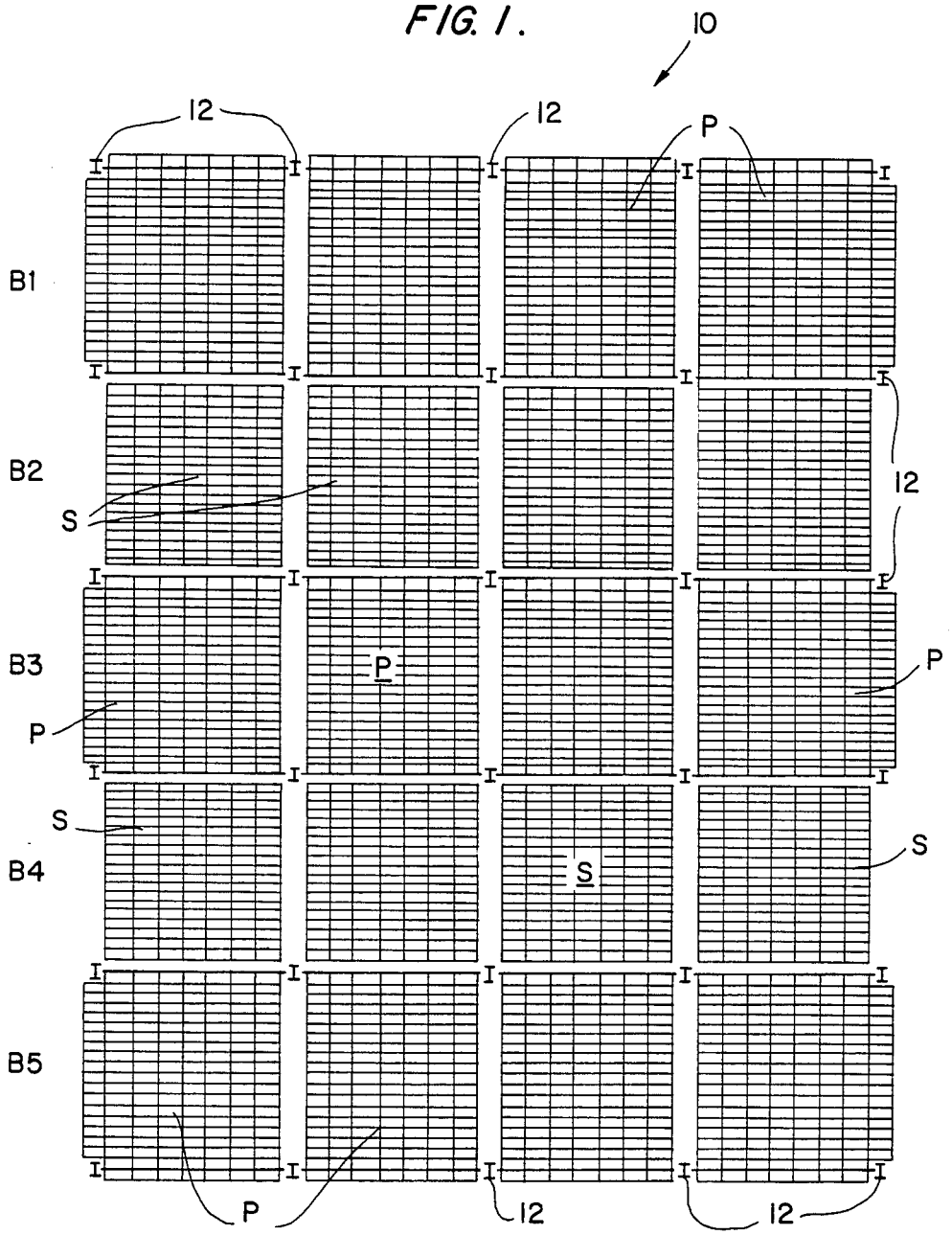
FIG. 1 is a schematic plan view of a preliminarily assembled roof structure showing primary and secondary panels as assembled in panel areas within each bay defined between spaced parallel lines and transverse rows of upstanding load supporting columns.
Figure 2:
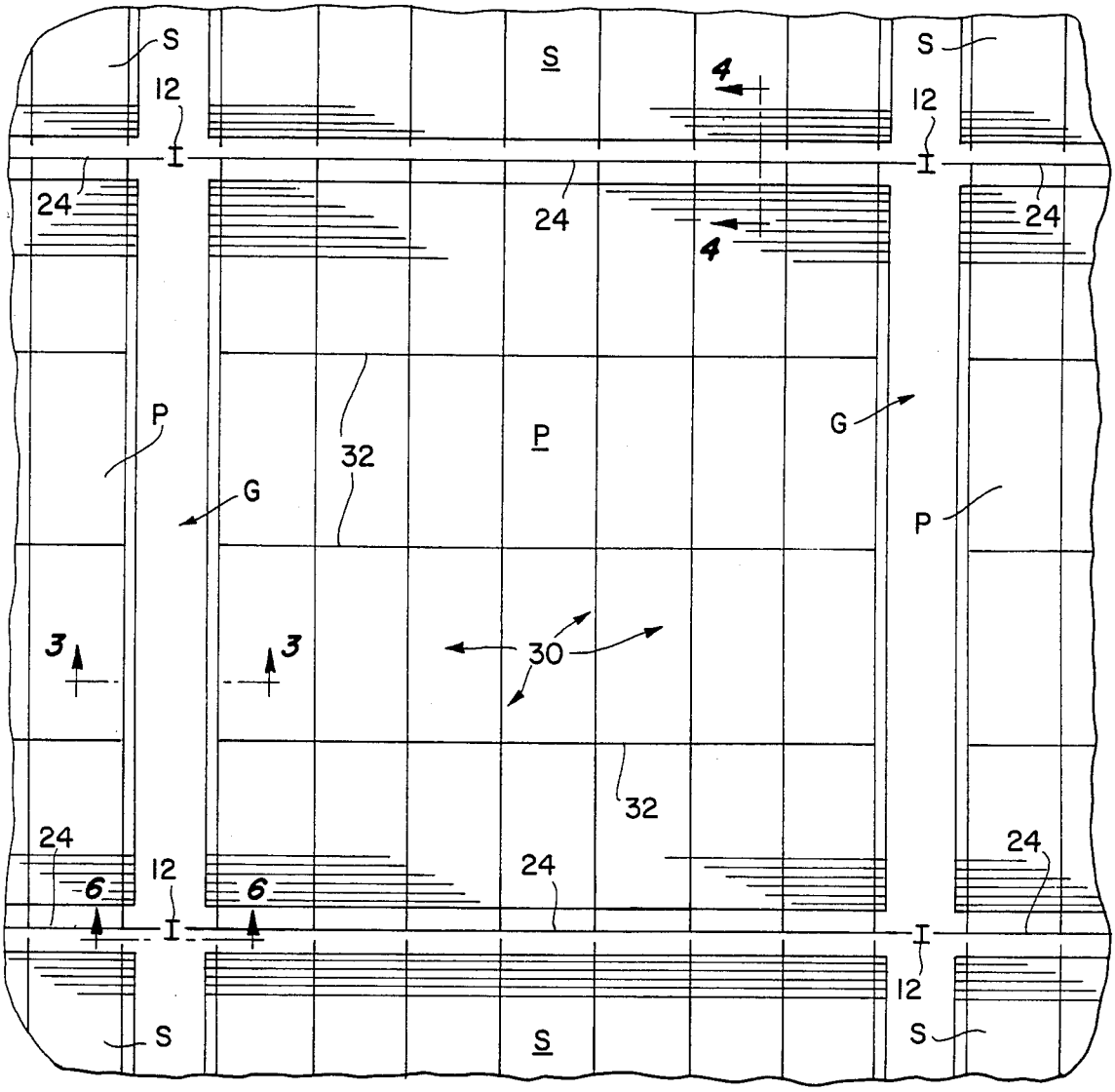
FIG. 2 is an enlargement of a segment of the schematic plan view of FIG. 1, diagramatically showing the relationship between primary and secondary panels as assembled relative to the upstanding columns on which they are to be finally supported.

For an overall understanding of the building construction method, reference may initially be made to the schematic plan view showings on FIGS. 1 and 2 of the drawings. FIG. 1 shows the plan layout of a building roof structure 10, interrelating the primary and secondary panels P and S, respectively, which are to form the roof structure with the upstanding load supporting columns 12 which are to support this roof structure in constructing a single story building.

FIG. 2 displays, in schematic diagram, a segment of the roof structure 10, displaying in enlarged detail the relationship between primary and secondary panels P and S, each panel serving to form the roof structure over a panel area that is defined by a group of four columns, one located at each of the four corners of each panel area. For simplicity of illustration, the schematic diagrams shown in plan of FIGS. 1 and 2 do not show structural details, these details being better illustrated on FIGS. 3, 4, and 6 of the drawings which are taken from the section lines for these three figures appearing on FIG. 2.

As may be best visualized from the schematic plan diagram of FIG. 1, the upstanding load-supporting columns 12 are installed in an array to be disposed in spaced parallel lines (the horizontal lines of columns 12 on FIG. 1) and in transverse parallel rows (the vertical rows of columns 12 as seen on FIG. 1). With this relationship of the load-supporting columns 12 in the installed array, a bay is defined between each pair of adjacent column lines. As again seen on Figure 1, the upper pair of adjacent column lines define bay B1. The next pair, bay B2, with the third, fourth and fifth pairs of adjacent column lines defining bays B3, B4 and B5, respectively.

Within each bay B1, B2, B3, B4 and B5, in the example shown on FIG. 1, there are four rectangular panel areas. Each of these panel areas is defined between each group of four columns located at the corners of each panel area. As will be explained in more detail hereinafter, under the building construction method, the panels which are to form the roof structure of the single story building roof structure 10 are assembled in the panel area that the particular panel is to form the roof structure for. All of the panels are assembled in their respective panel areas at a convenient working height above the ground surface near ground level where the construction workers can carry out their duties with ease, efficiency and under safer working height conditions.

For reasons that will become clear subsequently, there are two basic types of roof structure panels, these being identified as primary panels P and secondary panels S. The primary panels P are assembled in their respective panel areas to form the roof structure over alternate bays within the building roof structure 10. Similarly, the secondary panels S as assembled in their respective panel areas to form the roof structure over bays intermediate to the alternate bays where the primary panels are assembled. Thus, referring to the designations for the bays as shown on FIG. 1, each of the four primary panels P for a bay are to be assembled in the panel areas of alternate bays B1, B3 and B5. And likewise, the secondary panels S which are to form the roof structure for the intermediate bays would be assembled in the four panel areas of each of intermediate bays B2, and B4.

Relating the schematic plan diagram as enlarged in FIG. 2 to the overall plan of a building roof structure 10 as shown on FIG. 1, the panels on FIG. 2 may be visualized as depicting a segment of the roof structure interiorally of the edges of such structure with the center panel on FIG. 2 being a primary panel P with portions of two primary panels P being shown as might make up a section of, for example, bay B3. Similarly, the portions of panels above and below panels P on FIG. 2 would represent portions of secondary panels S which would be assembled in the intermediate bays B2 and B4.

Before proceeding with describing the components which are assembled in constructing the primary panels P and secondary panels S, reference may be made to the manner in which the ground surface on which the building is to be constructed may be prepared and a manner in which the upstanding load-supporting columns 12 arranged in the array initially described may suitably be installed. For an understanding of these techniques, reference may best be made to FIG. 6 on the drawings.

As shown on FIG. 7, the ground area 14 for the building to be constructed on is leveled and otherwise prepared in accordance with known land preparation procedures. Column foundations 16 are appropriately located to provide a foundation for the base of each column 12 to be arranged in the array described above with reference to FIG. 1. Foundation 16 may be of poured concrete with the usual anchor bolts (not shown) projecting upwardly from the surface of the foundation 16 to fixedly secure the baseplate of each column 12, again in accordance with known construction techniques.

At this stage the floor slab 18 of poured concrete can be built, providing box outlets for the bases of columns 12. If the floor slab is poured at this early stage, with the columns 12 thereafter being installed, when the anchor bolts have been tightened to the baseplates of the installed columns, grout can be placed between the foundation 16 and baseplate for each of the upstanding load-supporting columns 12. An advantage for building the floor slab 18 prior to assembly of the roof structure primary and secondary panels with their related facilities is that the finished floor slab provides a smooth working surface for the construction equipment and workers who are to carry out the subsequent operations necessary in the building construction method.

Whether the slab 18 is applied over the prepared ground area 14, one or both of these operations provides a prepared ground surface above which the array of load-supporting columns 12 projects. In the embodiment specifically illustrated on FIG. 6 the concrete floor slab 18 provides the prepared ground surface 20.

After the array of upstanding columns 12 has been installed with each column having been positioned, plumbed, and shimmed for proper elevation, the anchor bolts securing the baseplate of each column 12 are tightened, leaving the array of columns forming bays between adjacent column lines and defining rectangular panel areas between each group of four columns located at the corners of each such panel area.

Each primary panel P includes a pair of beams 24 located, respectively, at each end of the primary panel. Each of the beams 24 is of a length to extend between adjacent columns 12 in a line of these columns, a line of columns 12 having been described with reference to FIG. 1. The locations of this pair of beams 24 on a panel P is diagramatically shown on FIG. 2, this figure illustrating how the beams 24 are of a length to extend between adjacent columns in a line of the columns 12.

Figure 6:
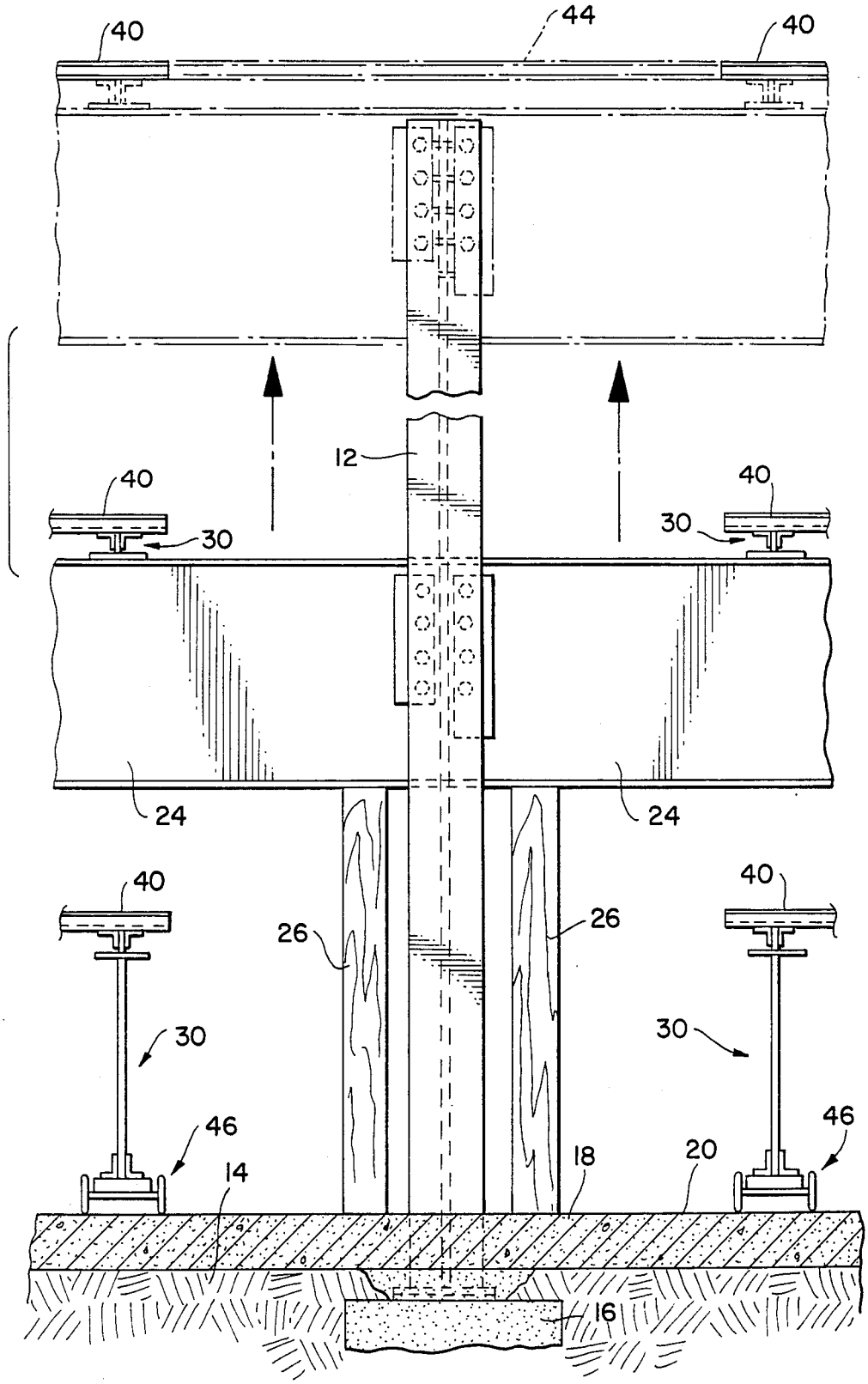
FIG. 6 is a sectional view taken on line 6—6 of FIG. 2 diagramatically showing construction techniques for assembling, storing and thereafter raising primary and secondary roof structure panels under the building construction method.

To enable the primary and secondary panels to be assembled in the panel areas at a convenient working height above the ground surface 20 of concrete slab 18 where the construction workers and equipment needed for them to perform their duties can easily be accommodated, the ends of each beam 24 are appropriately supported by blocking 26 resting on the surface 20 of floor slab 18 as shown in FIG. 6. While the ends of these beams 24 extend into the outwardly facing channels of the I beam columns 12, these beam ends are not secured to the columns 12 at the stage when they are supported at the convenient working height on blocking 26. On FIG. 6 the phantom showing of the beams and arrows seek to illustrate the location of the beams when they are raised to the upper ends of columns 12 and thereupon connected by bolting or other connecting techniques to the columns to form the final roof structure overlying the upper ends of columns 12.

It might also be mentioned that supporting beams 24 on blocking 26 to locate them at a convenient working height for further assembly operations in completing the primary and secondary panels, also supports the beams at a sufficient height above the surface 20 of floor slab 18 to allow for subsequent temporary storing of secondary panels S beneath primary panels P. As will be explained in more detail, the temporary storage of the secondary panels beneath the primary panels or other temporary storage of selective ones of the panels in overlying relation to each other is of advantage in clearing a portion of the intermediate bays B2 and B4 (FIG. 1) whereafter this cleared portion is available to accommodate lifting equipment such as a crane that is utilized to successively raise the individual panels to the tops of columns 12 for connection to the upper ends of these columns located at the four corners of each panel area.

With this pair of beams 24 appropriately supported at the convenient working height as on blocking 26, the next step in the building construction method involves securing spaced joists 30 perpendicularly to and extending between the parallel beams 24 for each primary panel P. These joists 30 may take the form, as shown on the drawings, of lightweight steel roof trusses with the ends of each joist resting on the upper flange of the beams 24 as may be seen on FIG. 6. While a truss-type roof joist has been illustrated, it will be understood that other forms of joist constructions may be employed within the intent of the invention herein.

The location of the spaced joist 30 may also be visualized for the construction of panel P as it is diagramatically illustrated on FIG. 2.

In the construction of each primary panel P within the panel areas making up the alternate bays B1, B3 and B5 (FIG. 1), each of the spaced joists extending between the beams 24 at the ends of each panel P will preferably have its ends permanently welded to these beams 24 or otherwise secured to the beams 24 in a more or less permanent fashion. Thereafter, joist bridging 32 is secured extending perpendicularly of the joists 30. As may be seen on FIGS. 3 and 4, with the truss-type roof joist 30 being employed, joist bridging 32 may be easily installed by welding to the undersides of the joists 30, this serving to stabilize the positioning of the joists relative to their support on the flanges of beams 24 located at the opposite ends of each primary panel P.

The location of joist bridging 32 may also be visualized as it is diagramatically shown with reference to the schematic of panel P on FIG. 2.

With primary panels P assembled as above described in each of the four panel areas within each of the alternate bays B1, B3 and B5, assembly of the secondary panels in each of the four panel areas making up the intermediate bays B2 and B4 may be undertaken. On the other hand, it should be clear that assembly of all primary panels need not be completed before commencing assembly of the secondary panels. Visualizing the plan diagram of FIG. 1, the assembly of primary and secondary panels in their respective panel areas may reasonably commence and continue from any point in the overall roof structure area. For example, proceeding with assembly of primary and secondary panels commencing from a corner of the roof structure area might be more efficient and expeditious in carrying out the entire building construction method.

Assembly of the secondary panels is quite similar to that described above with respect to the primary panels. The basic difference between the primary and secondary panels is that the secondary panels are not provided with the pair of beams 24 such as each of the primary panels P incorporates at its opposite ends. The joists of the secondary panels in effect utilize beams 24 of the primary panels that are located in adjacent ones of the alternate bays, the secondary panels being assembled in the intermediate bays.

Thus, in the assembly of the secondary panels S spaced parallel secondary panel joists such as of the truss-type joist 30 have their ends supported on the beams 24 of the primary panels that have been assembled and are located in adjacent ones of the alternate bays. For example, referring to FIG. 2, the primary panel P has its joists welded to the upper flanges of the beams 24 at the opposite ends of this panel P. In contrast, the ends of the joists 30 to make up secondary panels S will only temporarily be secured to the beams 24 of these primary panels. Indeed, only certain of the joists 30 within a secondary panel S need be temporarily bolted to beams 24.

Thereafter, secondary joist bridging 32 is secured as by welding perpendicularly of the secondary panel joists to provide the joists with the necessary rigidifying strength in holding the joists in place when they are disconnected from their temporary securement to the beams 24 of the adjacent primary panels.

It will be noted that the endmost joists 30 of each of the primary and secondary panels P and S are secured inwardly of the ends of the beams 24. In other words, these endmost joists do not lie on the center lines of the rows of columns 12, these rows separating the panel areas within each of the bays B1, B2, B3, B4 and B5 as may be visualized from the diagramatic showing on FIGS. 1 and 2. This leaves a gap area G running along this center line of the rows of columns.

The importance of this placement of the endmost joists 30 on each of the primary and secondary panels will be appreciated in that this enables the panels to be moved in between adjacent columns 12 so that selected ones of the panels can be temporarily stored in overlying relationship to each other to thereby clear a portion of the surface 20 within the intermediate bays B2 and B4 so that this cleared portion can be utilized to accommodate lifting equipment. This equipment (not shown) is effective in successively raising the primary and secondary panels to the upper ends of the columns 12 where they are connected to the columns disposed at the four corners of each panel area.

Figure 5:
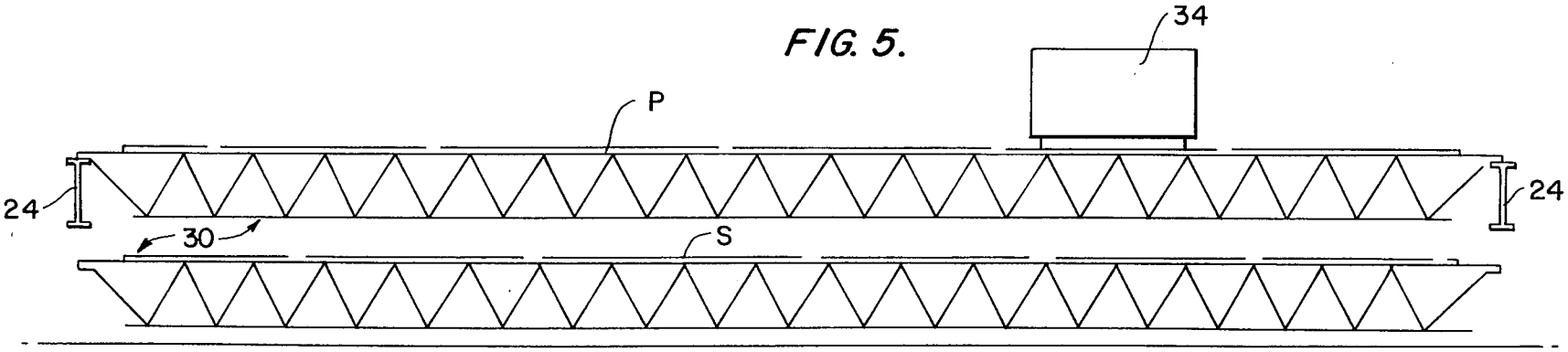
FIG. 5 is a diagramatic illustration of one approach for temporarily storing selected secondary panels to underly predetermined primary panels.

As the joists 30 for the primary and/or secondary panels are being installed while assembly is being undertaken at the convenient working height near the ground surface on blocking 26, roof top and mechanical units as may be eventually needed for the building's facilities, such as heating and cooling machinery for the building, can be installed on the roof structure panels. Such a unit 34 is diagramatically illustrated on FIG. 5. Since mechanical units of this type can require a long order lead time, they also may be installed at the time of lifting the panels from their low height assembly area after the secondary panels have been stored to clear the portion of the intermediate bays. Then, the primary panels are readily accessible to the lifting equipment such as a crane. Since, the permanently assembled original construction of the primary panels P is more stable, mechanical units 34 preferably are installed only on primary panels.

Figure 3:
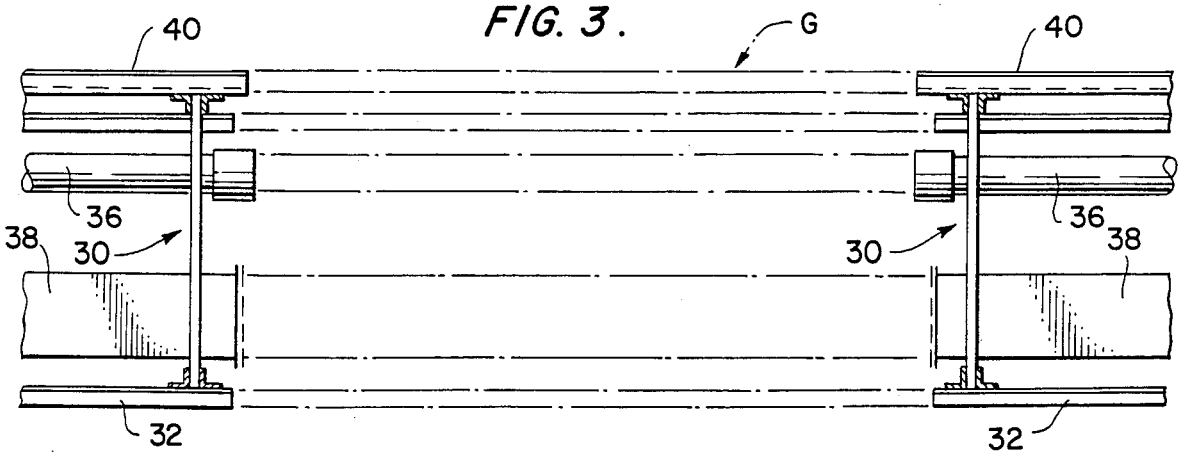
FIG. 3 is a sectional view taken on line 3—3 of FIG. 2 indicating how roof structure gap sections as well as electrical and mechanical facilities for the building are to be installed.
Figure 4:
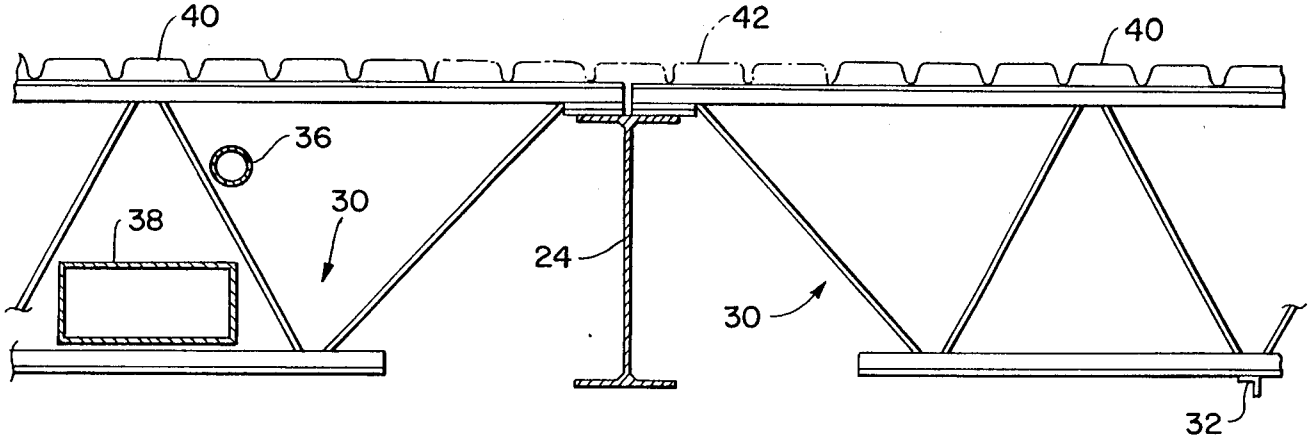
FIG. 4 is a sectional view taken on line 4—4 of FIG. 2 showing a primary beam with primary and secondary panel joists supported thereon.

Also electrical conduit and mechanical piping 36, along with ductwork 38 as shown on FIGS. 3 and 4, can be easily installed when the panels are being assembled while supported at a convenient working height near the floor surface 20 as by means of blocking 26. Such piping and ductwork are usually and conveniently placed within the depth of the joists 30 as shown on FIGS. 3 and 4. Also, piping and ductwork are provided for gaps G between adjacent panels by prefitted removable sections as indicated by dot-dash lines on FIG. 3. These sections are removed prior to lifting the panels and are reinstalled after the roof panels are lifted and connected in final position.

As the joists 30 are being installed to make up the primary and secondary panels in combination with the beams 24, bundles of roof deck sheets 40 may be placed on the joists 30 in a position to be readily available for later use. The complete panel assembly after the electrical, mechanical and other facilities required for the building have been installed on the panel sections may have the roof deck sheets 40 installed and anchored into place extending transversely of the joists on the panels. This leaves a small gap in the roof decking which is filled in later by the roof deck sheet 42 shown in phantom on Figure 4 and by roof deck sheet 44 shown on FIG. 6.

With the above-described assembly steps completing the ground level assembly of the structural elements making up the primary and secondary panels, and the mechanical and electrical completed, reference may be made to the construction procedure for lifting the panels successively into place for final connection to the upper ends of the columns 12.

With assembly of the primary and secondary panels having taken place in the panel areas that each panel is to form roof structure for, the panels P and S would cover the ground area of the building roof structure 10 in the manner diagramatically suggested on FIG. 1. Working access for a lifting crane or other equipment to successively elevate the panels would be unavailable. Thus, the first step in the lifting operation is to temporarily store selected ones of the panels in overlying relationship to each other to thereby clear at least a portion of the intermediate bays B2 and B4 to provide access within the surface 20 of these bays for the needed lifting equipment. This enables the lifting crane to operate adjacent to the panels that it will be lifting to their final elevated position for connection to the upper ends of columns 12 disposed at the four corners of each panel area.

While this temporary storing of selected panels in overlying relationship to clear an aisle in a portion of the intermediate bays for the lifting crane can be done in a number of manner, it is preferred that one or more secondary panels S be stored temporarily beneath predetermined primary panels P that are located in one of the alternate bays B1, B3 or B5 that is adjacent to the intermediate bay where the secondary panel was assembled.

To accomplish this, the secondary panel S to be stored has its joists 30 unbolted from the beams 24 to which they were temporarily secured. Then a crane or other lifting equipment lifts the secondary panel slightly, tilts it to move the ends of its joists 30 clear of the beams 24 of the adjacent primary panels and lowers this secondary panel onto a suitable support such as a wheeled dolly 46 that is supported on the ground surface 20 in the manner shown in FIG. 6. This dolly supported secondary panel is then shifted to underlie an adjacent primary panel P such as in the fashion diagramatically shown on FIG. 5. This secondary panel S is of a size that it can be rolled under the beams 24 of primary panel P by reason of the placement of the outermost joists 30 of each panel so that they are secured inwardly of the ends of the beams 24. Thus as will be seen from FIG. 6, the secondary panels S then clear the blocking 26 with the primary panels P supported high enough for the secondary panels to be rolled on dollies 46 underneath them. Thus the gaps G left in the roof deck assure that the secondary panels S are short enough to clear the blocking supports 26 of the primary panels P.

It will be recognized that selected ones of the secondary panels S could be stored on top of predetermined primary panels P. Such a temporary storing technique will certainly not work if the mechanical units are mounted on top of the primary panels. Thus, a stronger crane would be required to lift the primary panel to its final elevated position if a secondary panel is stored on top of the primary panel as it is lifted.

It also is possible that the secondary panels be constructed in subdivided or half size form so that they can be stored on top of each other within their own intermediate bay. This approach results in a narrower access aisle for the lifting crane than would be available in the other techniques for temporary panel storage described above.

It will be recognized that without describing the different panel storage relationships that are possible, the broad concept is that secondary panels assembled within intermediate bays are to be stored relative to other panels in overlying relationship only as is necessary to clear a sufficient portion of the surface 20 in the intermediate bays to allow lifting equipment access to carry out the successive raising of each of the primary and secondary panels to the upper ends of the columns 12 in completing the building construction.

To give a specific example, in a building roof structure 10 having five bays with four roof structure panels in each bay as illustrated on FIG. 1, each of the primary and secondary panels might be forty feet by forty feet to form the roof structure over each panel area as defined by the columns 12 at the four corners of each panel area. The first three secondary panels S in intermediate bay B2 (counting from the left in FIG. 1) could be disconnected and lowered onto wheeled dollies 46, and then rolled beneath the first three primary panels in the adjacent alternate bay B1.

The fourth secondary panel S in bay B2 may be simply disconnected from beams 24 of the primary panels located in adjacent alternate bays B1 and B3 with fourth secondary panel S simply being lowered onto the surface 20 of concrete slab 18. The fourth panel need not be stored since the lifting equipment in the form of a crane utilizing the cleared portion of intermediate bay B2 need not have access beyond the area cleared by storing the first three secondary panels that were assembled in intermediate bay B2.

A similar approach to clearing a portion of intermediate bay B4 might be followed with the first three secondary panels S stored, for example, beneath the primary panels P in the adjacent alternate row B3. Again the fourth secondary panel S in intermediate bay B4 need only be disconnected from the beams 24 of the primary panels P forming the fourth panel in each of alternate bays B3 and B5 and this fourth secondary panel S lowered onto surface 20 of slab 18.

With the above-described cleared portions of intermediate bays B2 and B4 allowing access for a lifting crane onto the surface 20 of slab 18, successive lifting of the individual primary and secondary panels by the lifting crane can proceed. For example, again referring to FIG. 1, with the crane located in the panel area where the third secondary panel S in intermediate bay B4 was assembled and with this particular panel already having been stored, the lifting crane might lift the lower right primary panel P in bay B5 (FIG. 1) to its final, raised roof level position whereat its beams 24 are connected to the upper ends of the columns 12. While still in this location, the lifting crane would lift the fourth primary panel in alternate row B3 to its final raised position whereat its beams 24 are connected to the load-supporting columns 12 at the corners of this primary panel.

Then, with the lifting crane still positioned in the same location, the fourth secondary panel making up bay B4 could be lifted to its final position and the joists 30 of this secondary panel positioned to overly the flanges of the beams 24 of the primary panels located in the adjacent alternate bays B3 and B5 which have just been connected to the upper ends of the columns 12. These joists 30 of the fourth secondary panel in bay B4 are then welded to the beams 24 of the primary panels located in the adjacent alternate bays B3 and B5.

Thereafter, the lifting crane backs up to the location where the second secondary panel in intermediate bay B4 was assembled which, as described above, is an area that had been cleared by storing this panel under an adjacent primary panel in alternate bay B3. At this point the third primary panels of alternate bays B3 and B5 are lifted into final raised position and their beams 24 connected to the upper ends of the columns 12 disposed at the corners of each of these primary panels. Then, the third secondary panel of intermediate bay B4 which had been stored under the third primary panel of bay B3 is rolled back into its original location in intermediate bay B4, lifted to its final position with its joists disposed to overly the beams of the primary panels located in adjacent alternate bays B3 and B5. With these joists of the third secondary panel in bay B4 being so positioned, they are welded to the beams 24 of the primary panels located in the adjacent alternate bays B3 and B5.

This procedure is followed with the crane backing out of the cleared portion of intermediate bay B4 until all panels readily accessible to that cleared portion of bay B4 have been raised and connected in the manner described above.

Then, the lifting crane is moved to the previously cleared portion of intermediate bay B2 and the procedure repeated until all of the primary and secondary panels have been lifted with the beams of he primary panels being connected to the upper ends of the load-supporting columns 12 and the joists 30 of the secondary panels positioned to overly the beams of adjacent primary panels and the ends of these joists thereupon welded to these beams 24.

With the lifting of the entire group of primary and secondary panels, and their connection to columns 12 completed to be supported on the upper ends of the columns 12, the gap sections G, including joist bridging members as shown in phantom on FIG. 3, are installed at the roof level. These gap sections have been previously fitted with coupling sections for the electrical and mechanical piping 36 as well as duct sections for the ducts 38 located in the adjacent roof structure panels.

Thus in completing the building roof structure 10, the roof gaps G which run along the center line of the rows of columns 12 created by the particular placement of the endmost joists 30 on each of the primary and secondary panels are filled in by gap sections (shown in phantom on FIG. 3) being installed. These gap sections then overly each of columns 12 to complete the building roof.

Finally, roof decking may be placed on the gap sections to bridge between the roof decking 40 thereby completing the roof structure for the single story building.

The completed structure as described hereinabove, is well-designed and capable of resisting vertical or gravity loads through the ample support of columns 12. It is also well suited to resist horizontal wind or earthquake loads. Indeed, wind bracing can be provided along the exterior walls by vertical X bracing extending from the foundation to the roof. It may also be provided by frame action offered by the columns 12 and roof components. This last method of wind bracing can be accomplished utilizing the building contruction method herein disclosed where wind trusses are disposed along the parallel rows of columns 12. Since the innermost joists 30 of each panel are spaced inwardly of the ends of beams 24, these rows of columns 12, as where the gaps G are shown on FIG. 2, are clear for easy installation of wind trusses if this is the type of wind bracing that the designer wishes to use in conjunction with the disclosed building construction method.

Basically, the building construction method utilizes conventional materials and the individual installation techniques are known in the construction trades. However, the structural elements, except for the columns 12, can be installed with the use of a light truck-mounted crane, forklift truck, front-end loader or similar light building equipment. Workmen perform their task at ground level where they are safer and more productive.

While preferred embodiments of the invention have been disclosed in detail hereinabove, it will be apparent to those skilled in the art that the disclosed embodiments may be modified and varied within a wide range of structural details, all possible and recognizable within the spirit of the invention herein. Therefore, the foregoing description and accompanying drawings are to be considered only as exemplary and not limiting, the true scope of the invention being defined and established by the appended claims.

I claim:

1. A method for constructing an entire roof system for single story building structures comprising:

installing an array of upstanding columns upon a prepared ground surface in spaced parallel lines and transverse rows to define bays between adjacent column lines with groups of columns in said adjacent lines defining therebetween the corners of panel areas within said bays;

assembling large primary and smaller secondary panels at a convenient working height near said surface, said primary panels to form the roof structure over alternate bays and said secondary panels to form the roof structure over bays intermediate to said alternate bays, assembling said primary panels including placing beams of a length to extend between adjacent columns in a line of columns at each end of each said primary panel, securing spaced joists perpendicularly to and extending between said beams with the end most joists secured inwardly of the ends of said beams, assemblying said seondary panels including temporarily securing to the beams spaced parallel secondary panel joists which extend between the beams of the primary panels located in adjacent ones of said alternate bays with the end most joists of said secondary panels being temporarily secured inwardly of the ends of said beams, and securing joist bridging perpendicular to said primary and secondary panel joists;

temporarily storing selected ones of said secondary panels in underlying relationship to selected ones of said primary panels to thereby clear said surface in at least a portion of said intermediate bays;

utilizing said portion of said intermediate bays to accommodate lifting equipment; and successively raising and connecting said primary and secondary panels to the upper ends of said columns that are disposed at the corners of each said panel area.

2. A method for constructing structures as recited in claim 1 wherein each of said panels is assembled in the panel area that the panel is to form the roof structure for.

3. A method for constructing structures as recited in either of claims 1 or 2 wherein selected ones of said secondary panels are temporarily stored relative to predetermined primary panels located in an adjacent one of said alternate bays.

4. A method for constructing structures as recited in claim 3 further comprising supporting said selected secondary panels on wheeled dollies; and shifting the dolly supported secondary panels to underlie said predetermined primary panels.

5. A method for constructing structures as recited in claim 1 wherein the endmost joists of each said panel are secured inwardly of the end of said beams to define roof gaps running along said traverse rows of columns between the ends of said panels, and further comprising installing roof structure gap sections in said roof gaps overlying each row of columns to complete the building roof.

6. A method for constructing structures as recited in claim 5 further comprising installing electrical and mechanical facilities for the building structure on said panels and said gap sections; and applying roof decking over said panels and said gap sections.

7. A method for constructing structures as recited in any of claims 1 or 2 further comprising installing electrical and mechanical facilities for the building structure on said panels while assembling said panels near said ground surface.

8. A method for constructing structures as recited in claim 7 further comprising appling roof decking over said panels.

9. A method for constructing structures as recited in any of claims 1 or 2 further comprising pouring a concrete floor slab as part of said surface.

10. A method for constructing structures as recited in claim 9 further comprising supporting selected ones of said secondary panels on wheeled dollies; and shifting the dolly supported secondary panels to underlie predetermined primary panels located in adjacent ones of said alternate bays.

* * * * *